United States Patent [19]

Leigh

[11] 4,018,436

[45] Apr. 19, 1977

[54] GOLF PRACTICE DEVICE

[75] Inventor: John U. Leigh, Morgan Hill, Calif.

[73] Assignee: The Raymond Lee Organization, Inc., New York, N.Y. ; a part interest

[22] Filed: Apr. 26, 1976

[21] Appl. No.: 680,284

[52] U.S. Cl. ..... 273/35 B; 273/182 A; 273/178 B; 273/176 H; 273/179 C

[51] Int. Cl.[2] ..... A63B 69/36

[58] Field of Search ..... 273/176 B, 176 H, 182 R, 273/182 A, 35 R, 35 B, 178 R, 178 A, 178 B, 181, 182, 176 F, 176 FA, 179

[56] References Cited

UNITED STATES PATENTS

| | | | |
|---|---|---|---|
| 3,025,059 | 3/1962 | Di Buono | 273/35 R |
| 3,826,501 | 7/1974 | Hiromachi | 273/182 R |
| 3,966,212 | 6/1976 | Mason | 273/178 B |

*Primary Examiner*—George J. Marlo
*Attorney, Agent, or Firm*—Daniel Jay Tick

[57] ABSTRACT

A simulated green comprises a plurality of panels positioned in coplanar relation next-adjacent each other to form a continuous surface inclined at a predetermined angle with a horizontal base. Each of the panels has spaced opposite parallel first and second edges. A mounting device pivotally mounts each of the panels on the base at the first edge of each of the panels whereby each panel is pivotally movable about its first edge from a closed position in which it is substantially coplanar with the other panels to an open position in which its second edge is raised above and spaced from the first edge of the next-succeeding panel sufficiently to permit the passage of a golf ball between next-adjacent panels. A control device mounted on the base is coupled to each of the panels for selectively moving the panels in unison to their closed and open positions.

3 Claims, 7 Drawing Figures

GOLF PRACTICE DEVICE

BACKGROUND OF THE INVENTION

The present invention relates to a golf practice device. Objects of the invention are to provide a golf practice device of simple structure, which is inexpensive in manufacture, installable with facility and convenience in a very limited area, enclosed or outdoors, and functions efficiently, effectively and reliably as a practice range for golfers.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
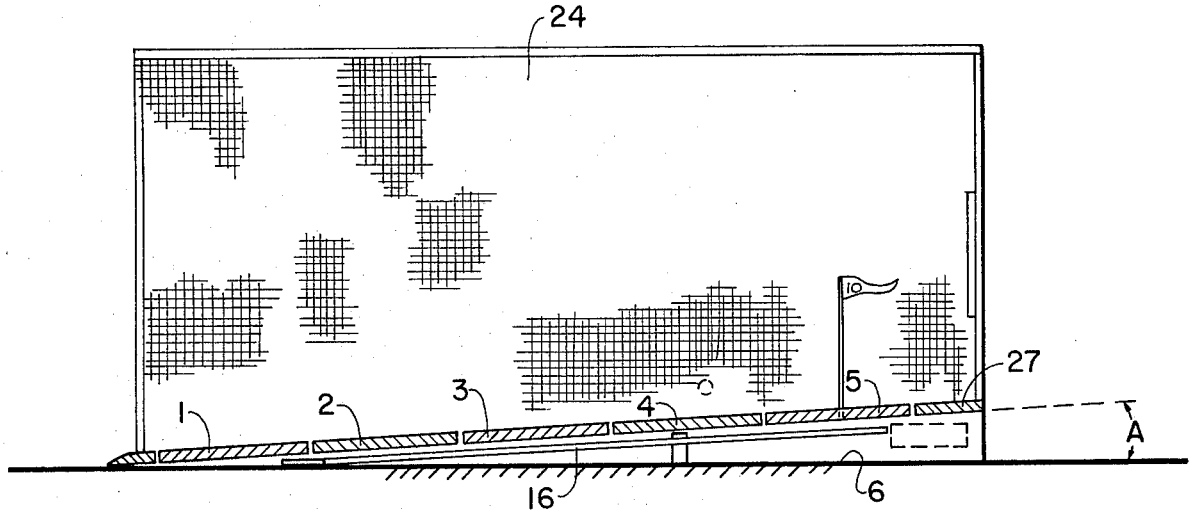
FIG. 1 is a side view, partly in section, of an embodiment of the golf practice device of the invention.

The golf practice device of the invention comprises a simulated green comprising a plurality of panels 1, 2, 3, 4 and 5 (FIGS. 1 and 2) positioned in substantially coplanar relation next-adjacent each other to form a substantially continuous surface inclined at a predetermined angle A (FIG. 1) with a horizontal base 6.

Each of the panels 1 to 5 has spaced opposite substantially parallel first and second edges. Thus, as shown in FIG. 3, the panel 1 has spaced opposite substantially parallel first and second edges 7 and 8, the panel 2 has spaced opposite substantially parallel first and second edges 9 and 10, and the panel 3 has spaced opposite substantially parallel first and second edges 11 and 12.

Figure 2:
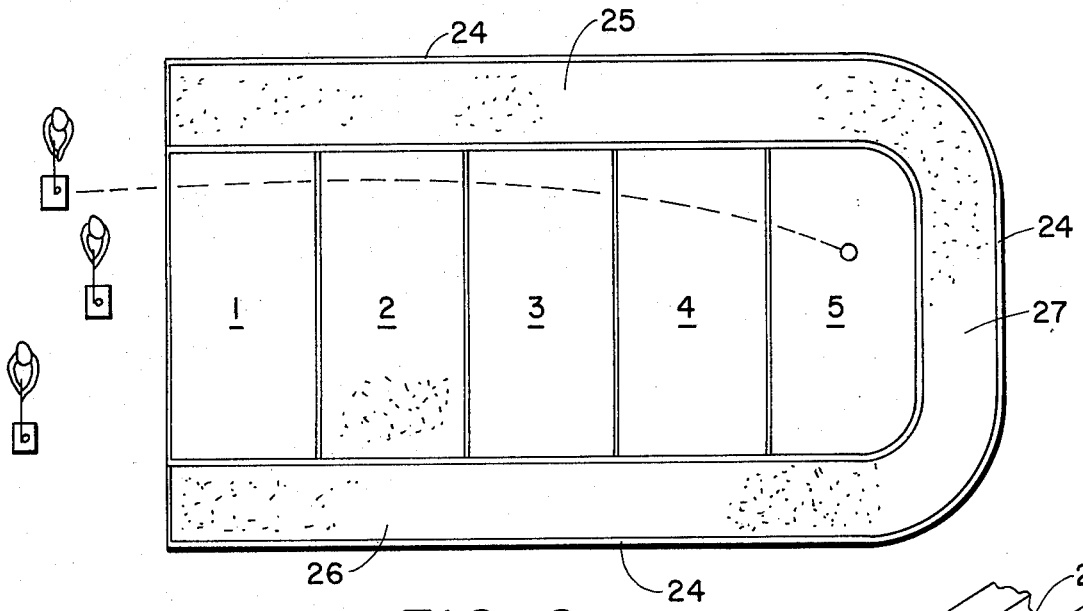
FIG. 2 is a top view of the golf practice device of the invention.
Figure 3:
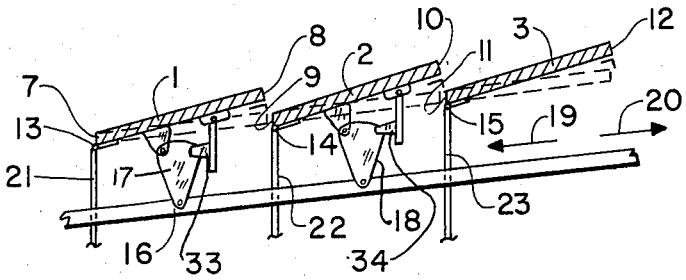
FIG. 3 is a side view, partly in section, of part of the golf practice device of the invention in its open position.

A mounting device pivotally mounts each of the panels 1 to 5 on the base 6 at the first edge 7, 9, 11, and so on, of each of said panels whereby each panel is pivotally movable about its first edge from a closed position in which it is substantially coplanar with the other panels, as shown in FIGS. 1 and 2, 4 and 5, to an open position in which its second edge 8, 10, 12, and so on, is raised above, and spaced from the first edge of the next-succeeding panel sufficiently to permit the passage of a golf ball between next-adjacent panels, as shown in FIG. 3. The panels 1, 2 and 3 may be pivotally mounted via pivot pins 13, 14 and 15, for example, as shown in FIG. 3.

Figure 4:
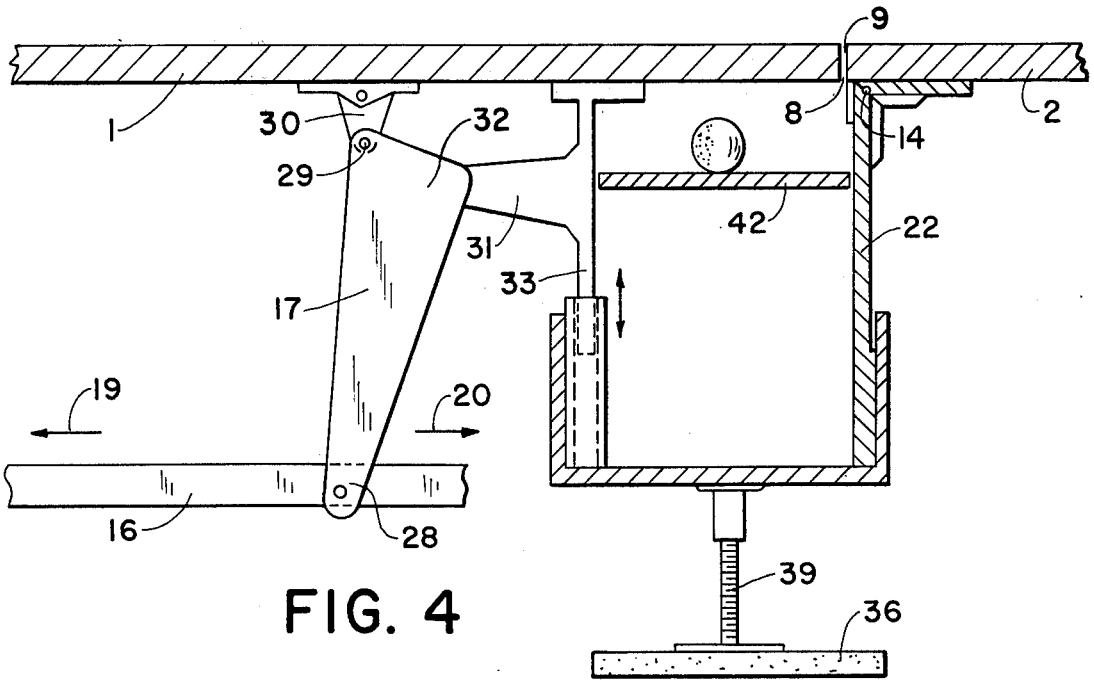
FIG. 4 is a side view, partly in section and on an enlarged scale, of part of the golf practice device of the invention in its closed position.

A control device is mounted on the base 6 and is coupled to each of the panels 1 to 5, for selectively moving said panels in unison to their closed and open positions. The control device comprises a shaft 16 (FIGS. 1, 3 and 4) pivotally coupled to each of the panels 1 to 5 via a coupling plate 17, 18, and so on (FIG. 3). Thus, when the shaft 16 is moved in the direction of an arrow 19 of FIGS. 3 and 4, the panels are moved to their closed positions, as shown in FIG. 4. When the shaft 16 is moved in the direction of an arrow 20 of FIGS. 3 and 4, the panels are moved to their open positions.

Figure 7:
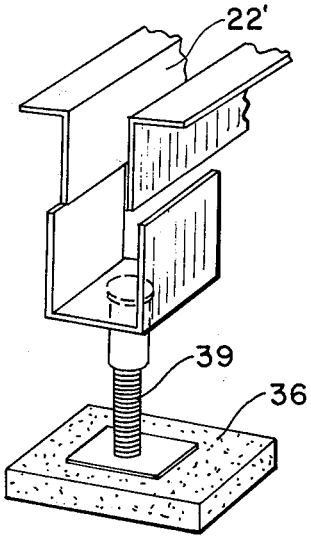
FIG. 7 is a perspective view, on an enlarged scale, of part of the golf practice device of the invention.

FIG. 7 illustrates a support member for supporting beams 21, 22, 23, and so on, which pivotally support the first edges of the panels 1, 2, 3, and so on, as shown in FIG. 3. Each of the supporting beams 21, 22, 23, and so on, has a cross beam 21', 22' (FIG. 7), 23', and so on, affixed to the top thereof.

Screening 24 (FIG. 1), such as, for example, netting of any suitable type, is provided around the simulated green at a predetermined distance therefrom for preventing golf balls from leaving the area of the green. As shown in FIG. 2, side panels 25, 26 and 27 are stationarily positioned on the base 6 in the area between the green, which is constituted by the panels 1 to 5 and the screening 24. The side panels 25, 26 and 27 incline inwardly from the screening to the green whereby golf balls on the side panels are returned to the green.

Each of the panels 1 to 5 is preferably covered with artificial turf of any suitable type.

Each of the coupling plates 17, 18, and so on, (FIGS. 3 and 4) is of the same configuration and is connected in the same manner to the underside of a corresponding one of the panels 1 to 5 in the same manner. Thus, the coupling plate 17 and accompanying parts are described with reference to the panel 1.

As shown in FIG. 4, the coupling plate 17 is of substantially triangular configuration and has a bottom angular part 28 pivotally affixed to the shaft 16 and a first top angular part 29 pivotally affixed to the underside of the panel 1 via a bracket 30. An arm 31 extends from the second top angular part 32 and is affixed to a movably mounted support beam 33. Each of the panels 1 to 5 has a movably mounted support beam 33, 34, and so on (FIG. 3), abutting the underside thereof for selectively moving the corresponding panel to its closed and open positions under the control of the coupling plates 17, 18, and so on.

Figure 5:
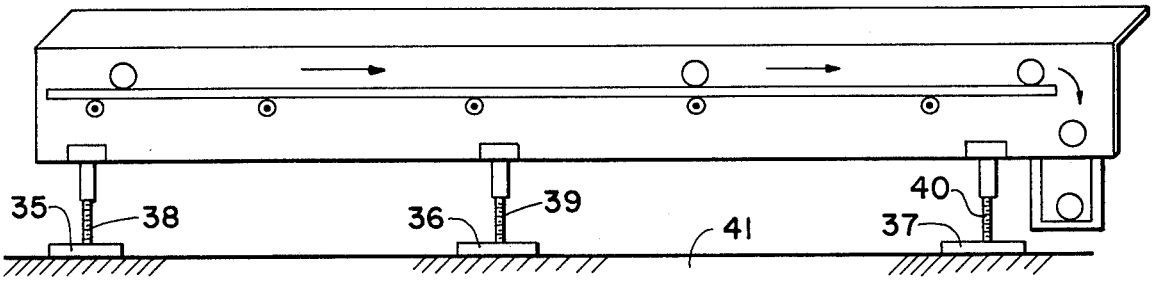
FIG. 5 is a side view of the golf practice device of the invention.

The golf practice device of the invention is mounted in a manner whereby the supports for the support beams 33, 34, and so on, and the supporting beams 21, 22, 23, and so on, are adjustable in their heights above supporting base plates 35, 36, 37, and so on (FIG. 5), in the manner of heavy duty jack members 38, 39, 40, and so on (FIG. 5). This permits the panels 1 to 5 to be positioned a desired distance above a supporting surface 41 (FIG. 5).

Each corresponding pair of support beams 33, 34, and so on, and supporting beams 21, 22, 23, and so on, have a raceway member positioned therebetween to catch golf balls and direct them to a return area. The raceway member 42 positioned between the support beam 33 and the supporting beam 22 is shown in FIG. 4.

Figure 6:
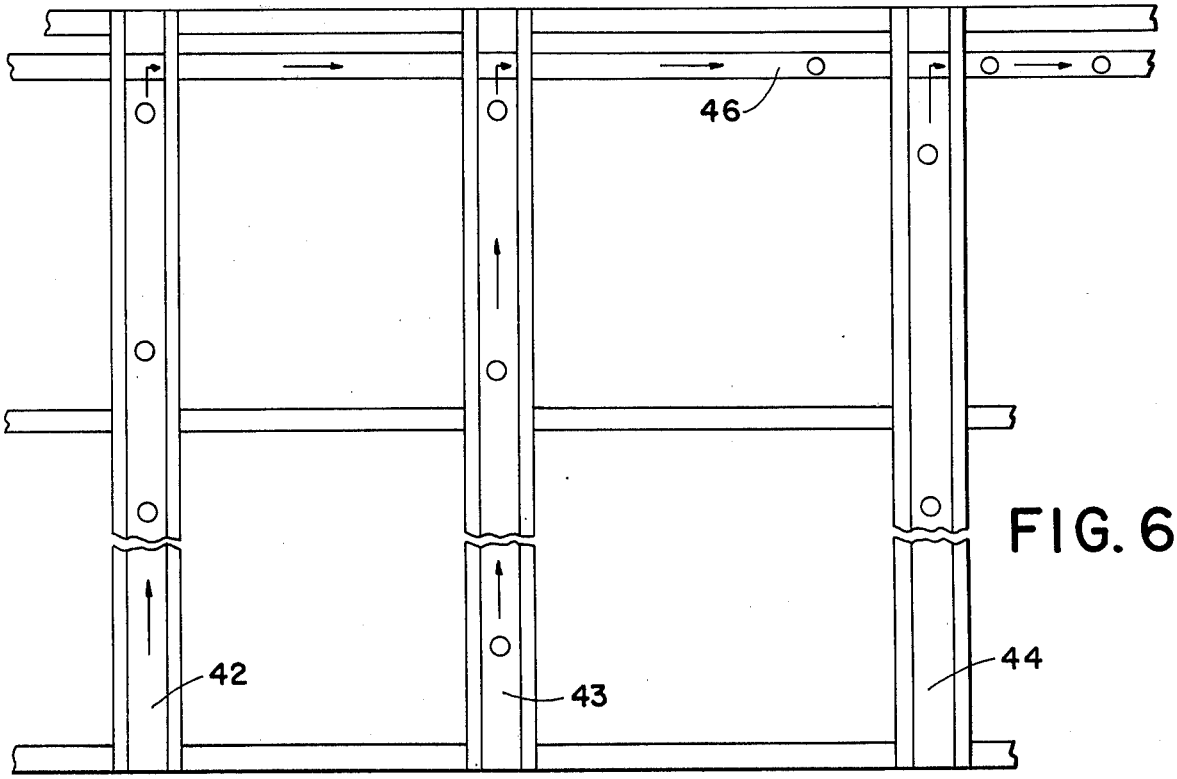
FIG. 6 is a top plan view, on an enlarged scale, of part of the golf practice device of the invention.

An embodiment of a golf ball return system for the golf practice device of the invention is shown in FIG. 6. In the embodiment of FIG. 6, a raceway member 42, 43, 44, and so on, is positioned between each corresponding pair of support beams and supporting beams, as hereinbefore mentioned and is mounted under the second edges 8, 10, 12, and so on (FIG. 3) of the panels 1 to 5. Thus, golf balls which roll down the upper surface of a panel roll into the corresponding raceway member. The raceway members 42, 43, 44, and so on feed into a master raceway member 46 (FIG. 6), which extends at right angles thereto, and directs all the golf balls to a return area.

While the invention has been described by means of a specific example and in a specific embodiment, I do not wish to be limited thereto, for obvious modifications will occur to those skilled in the art without departing from the spirit and scope of the invention.

I claim:

1. A golf practice device, comprising a simulated green comprising a plurality of panels positioned in substantially coplanar relation next-adjacent each other to form a substantially continuous surface inclined at a predetermined angle with a horizontal base, each of the panels having spaced opposite substantially parallel first and second edges;

mounting means pivotally mounting each of the panels on the base at the first edge of each of the panels whereby each panel is pivotally movable about its first edge from a closed position in which it is substantially coplanar with the other panels to an open position in which its second edge is raised above and spaced from the first edge of the next-succeeding panel sufficiently to permit the passage of a golf ball between next-adjacent panels; and control means mounted on the base and coupled to each of the panels for selectively moving the panels in unison to their closed and open positions.

2. A golf practice device as claimed in claim 1, further comprising screening around the simulated green at a predetermined distance therefrom for preventing golf balls from leaving the area of the green, and side panels stationarily positioned on the base in the area between the green and the screening, said side panels inclining inwardly from the screening to the green whereby golf balls on the side panels are returned to the green.

3. A golf practice device as claimed in claim 1, wherein each of the panels is covered with artificial turf.

* * * * *